US006010024A

United States Patent [19]

Wang

[11] Patent Number: 6,010,024

[45] Date of Patent: Jan. 4, 2000

[54] TRASH CAN WITH A CAP OPENED WITH A STEP

[76] Inventor: Tin-Chou Wang, No. 9, Wen Hua 5th Street, Kuei Jen Hsiang, Tainan Hsien, Taiwan

[21] Appl. No.: 09/266,726

[22] Filed: Mar. 12, 1999

[51] Int. Cl.[7] ..... A47G 19/00

[52] U.S. Cl. ..... 220/23.87; 220/263; 220/264; 220/908

[58] Field of Search ..... 220/23.87, 263, 220/264, 908, 908.1

[56] References Cited

U.S. PATENT DOCUMENTS

| | | | |
|---|---|---|---|
| 1,515,989 | 11/1924 | Banes | 220/264 X |
| 2,246,975 | 6/1941 | Geibel | 220/264 X |
| 4,081,105 | 3/1978 | Dagonnet et al. | 220/263 |
| 5,249,693 | 10/1993 | Gillispie | 220/263 |
| 5,440,978 | 8/1995 | O'Brien et al. | 220/264 X |
| 5,474,201 | 12/1995 | Liu | 220/23.87 |
| 5,531,348 | 7/1996 | Baker et al. | 220/264 |

*Primary Examiner*—Stephen K. Cronin
*Attorney, Agent, or Firm*—Rosenberg, Klein & Lee

[57] ABSTRACT

A trash can with a cap opened with a step includes an outer trash can, an inner trash can, a cap closing on the outer trash can, a moving mechanism and a step. The step is positioned outside of the outer trash can with a first end of a movable rod of the moving mechanism located just under the step. So, when the step is pressed down with a foot of a user, the movable rod moves up a connecting rod vertically to push the cap to swing up open, as the cap is pivotally connected with a projection fixed on a rear end of the cap. Further, a decorative cap is pivotally connected with the projection, hiding an upper end of the connecting rod protruding out of the outer trash can so as to beautify the whole shape of the trash can.

3 Claims, 4 Drawing Sheets

TRASH CAN WITH A CAP OPENED WITH A STEP

BACKGROUND OF THE INVENTION

This invention relates to a trash can with a cap opened with a step, which is pressed to move a moving mechanism to let the cap swing open.

A known conventional trash can with a cap opened with a step shown in FIG. 4 includes a trash can body 1 provided with a lower chamber 11, a connecting lever 2 contained in the lower chamber 11, a position shaft 17 supporting the connecting lever 2 by piercing through a center point of the lever 2, a U-shaped base 21 fixed on a rear portion of the lever 2 for supporting a compression spring 22 placed between the U-shaped base 21 and an inverted U-shaped base 12 fixed under an upper wall of the lower chamber 2. The rear end of the connecting lever 2 protrudes out of the wall of the trash can body 1 and connected pivotally with a lower end of a lower push rod 31 pushing a cap 4 to swing open.

The conventional trash can with a cap opened with a step further includes a large gear 32 and a small gear 33 supported by a lateral rod 13 fixed on the wall of the trash can body 1, an upper push rod 34 engaging with the large gear 32 and the lower push rod 31 engaging with the small gear 33 and the two rods 34 and 31 located at the same side of the two gears 32,33. Further, an adjusting screw 36 is provided to fit in an outer end of the lateral rod 13, and a coil spring 35 is fitted on the lateral rod 13 between the small gear 33 and the adjusting screw 36, with a protective cover 37 hiding the lateral rod 13, the two gears 32, 33 and having two, an upper and a lower, sides fixed on the wall of the trash can body 1 and with the head 361 of the adjusting screw 36 located at the outer side of the protective cover 37. Thus, the screw 36 can be rotated to tighten or lossen the two gears 32, 33 and the two rods 34, 31. The upper push rod 34 has its upper end protruding a lateral plate 14 fixed on the upper end of the trash can body 1 and fitting in a limit base 42 fixed on a bottom surface of the rear end of the cap 4, and an ear 43 formed on a rear end of the cap 4, and an ear 15 formed on the rear end of the lateral plate 14, and the two ears 43 and 15 are connected with a pivot 16 to let the cap 4 swing up with the pivot 16.

Then, a step 23 of the conventional trash can with a cap opened with a step is pressed down with a foot, moving the rear end of the lever 2 up and subsequently the lower push rod 31, next the small gear 33 rotates synchronously the large gear 32 to move up the upper push rod 34 orderly, forcing the cap 4 swung up open.

However, the known conventional trash can with a cap opened with a step is not only too complicated, taking much time in assemblage, but lose its beauty of its appearance by the two push rods 31,34, the two gears 32,33, spring, the adjusting screw 36 and the protective cover 37. In addition, it requires additional space for those components to the trash can body. Besides, the two push rods and the two gears are liable to be quickly damaged by excessive pressing force of the step.

SUMMARY

A purpose of the invention is to offer a trash can with a cap opened with a step, having a step on a lower outer portion of an outer trash can, and a first end of a movable rod of a moving mechanism just located under the step for moving a connecting rod connected with the movable rod, which then move a cap pivotally connected with the outer trash can swing up open for throwing trash in an inner trash can placed in the outer trash can. Further, a decorative cap is provided to pivotally connected to the cap for hiding an upper end portion of the connecting rod protruding out of a wall of the outer trash can.

Another purpose of the invention is to offer a trash can with a cap opened with a step, having a rubber piece fixed just under the step so as to reinforce friction between the step and the first end of the movable rod to ensure moving of the movable rod smoothly and accurately.

One more purpose of the invention is to offer a trash can with a cap opened with a step, having further an elastic member beside a buffer projection formed on a bottom base for supporting a second end of the movable rod. Thus, when the step is released from pressing down, the cap may not make a large sound in closing on the outer trash can because of elasticity of the elastic member.

BRIEF DESCRIPTION OF THE DRAWINGS

This invention will be better understood by reference to the accompanying drawings, wherein.

DETAILED DESCRIPTION OF THE PREFERRED EMBODIMENT

Figure 1:
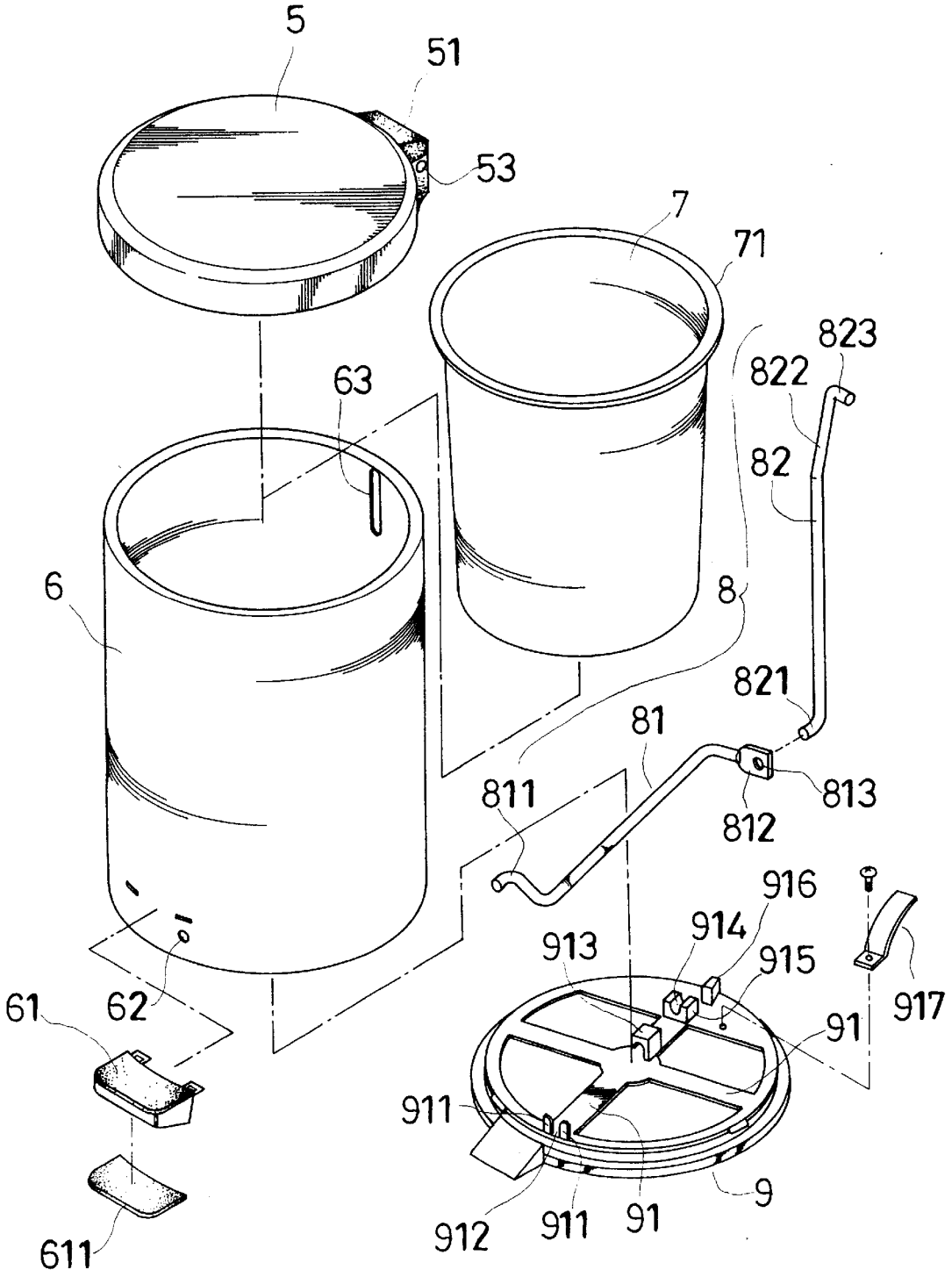
FIG. 1 is an exploded perspective view of a trash can with a cap opened with a step of the present invention.

A preferred embodiment of a trash can with a cap opened with a step of the present invention, as shown in FIG. 1, includes a cap 5, an outer trash can 6, an inner trash can 7, a moving mechanism 8 and a bottom base 9 as main components combined together.

The cap 5 has a projection 51 formed at a rear side, and the projection 51 has an ear 52 with a hole 521 formed inside, and a decorative cap 53 extending down from the projection 51.

The outer trash can 6 has a hole 62 in a front lower side, a slot 63 formed in an rear upper side, a step 61 pivotally connected with a front lower side, a rubber piece 611 fixed on a bottom surface of the step 61.

The inner trash can 7 has an annular flange 71 formed on an upper end to be laid on an upper end of the outer trash can 6 so as to let the inner trash 7 can placed in the outer trash can 6.

The moving mechanism 8 consists of a movable rod 81 and a connecting rod 82 connected to each other. The movable rod 81 has a first end 811 bending up slopingly to one side and a second end 812 bending for a right angle horizontally and having a round hole 813. The connecting rod 82 has a bent lower end 821 and an upper slowly-curved section 822 and an upper bent end 823. The round hole 813 of the movable rod 81 engages the bent lower end 821 of the connecting rod 82.

The bottom base 9 has a cross plate 91, two upright projections 911 formed at a front end of a first straight portion and separated with each other with a proper aperture, a 7-shaped projection 913 fixed near a center of the first straight portion, a U-shaped buffer projection 915 with a groove 914 located behind the 7-shaped limit projection on a rear end of the first straight portion, a stop projection 916 fixed behind the U-shaped buffer projection 915 on the rear end of the first straight portion. The U-shaped buffer prujection 915 functions to receive the movable rod 81 and to protect it when the cap 5 and the step 61 move down, preventing the mavable rod 81 and the connecting rod 82 from damaged. Further, an elastic member 917 is fixed beside the buffer projection 915.

In assembling, the moving mechanism 8 is deposited inside the outer trash can 6 and outside of the inner trash can 7, with the first end 811 of the movable rod 81 extending out of the hole 62 and under the rubber piece 611 of the step 61, with the upper bent end 823 of the connecting rod 82 extending out of the slot 63 and engaging the hole 521 of the ear 52 of the cap 5. Then, the decorative cap 53 pivotally connected with the ear 52 is secured outside the outer trash can 6, and hiding the upper end section of the connecting rod 82 exposing out of the outer trash can 6, with the cap 5 combined on the outer trash can 6. Then, the bottom base 9 is combined with the lower end of the outer trash can 6 with the movable rod 81 secured in the aperture 912, the limit projection 913 and the groove 914 of the buffer projection 915 on the bottom base 9. Then, the elastic member 917 supports the second end 812 of the movable rod 81. After that, the inner trash can 7 is placed in the outer trash can 6, with the stop projection 916 located just on the second end 812 of the movable rod 81. Thus, the whole trash can with a cap opened with a step is completed. And when the step 61 is pressed down, the first end 811 of the movable rod 81 is also pressed down to force the seond end 812 push up the connecting rod 82, which then pushes the cap 5 to swing open as shown in FIG. 2.

Figure 2:
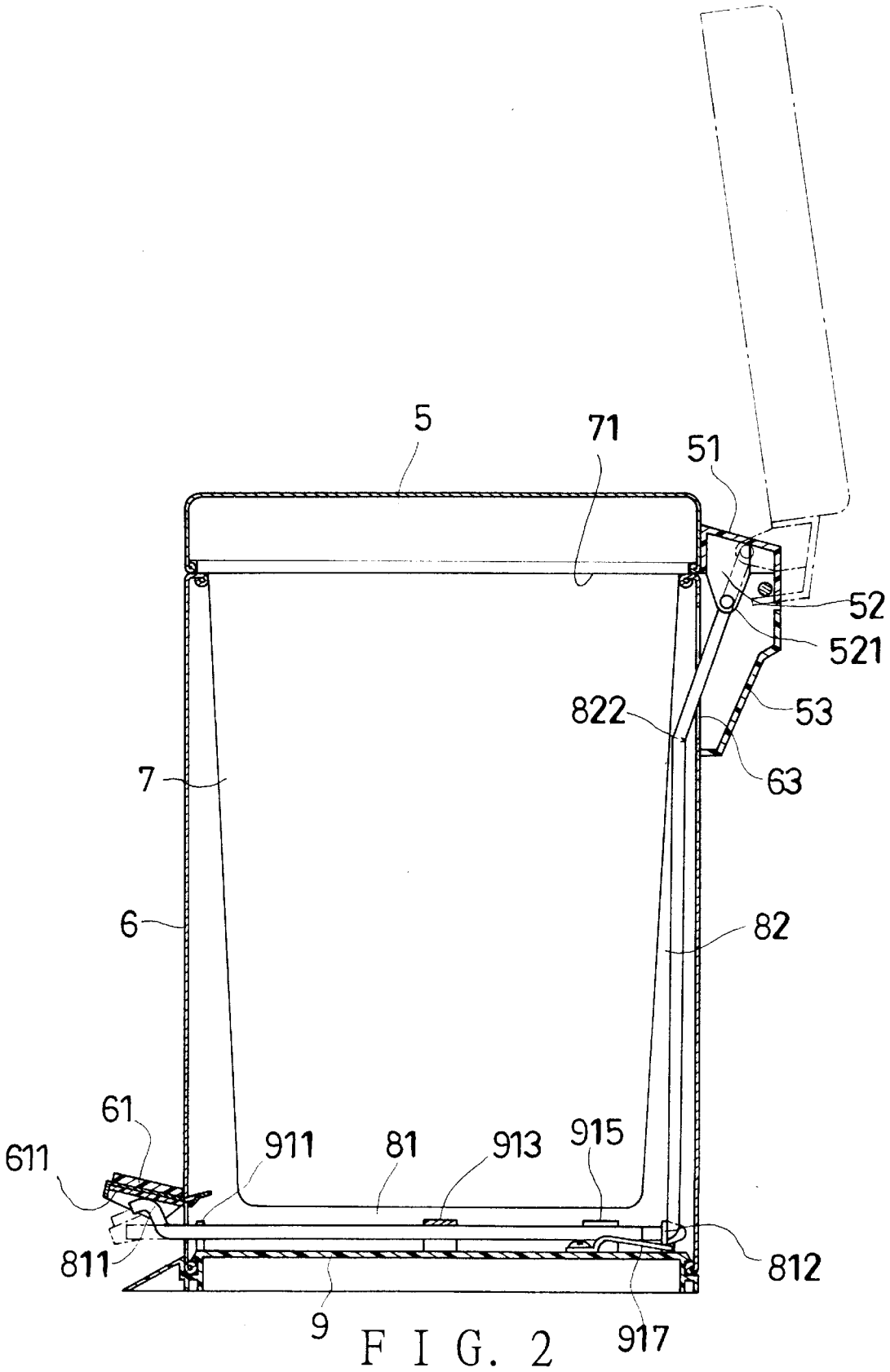
FIG. 2 is a cross-sectional view of the trash can with a cap opened with a step of the present invention.
Figure 3:
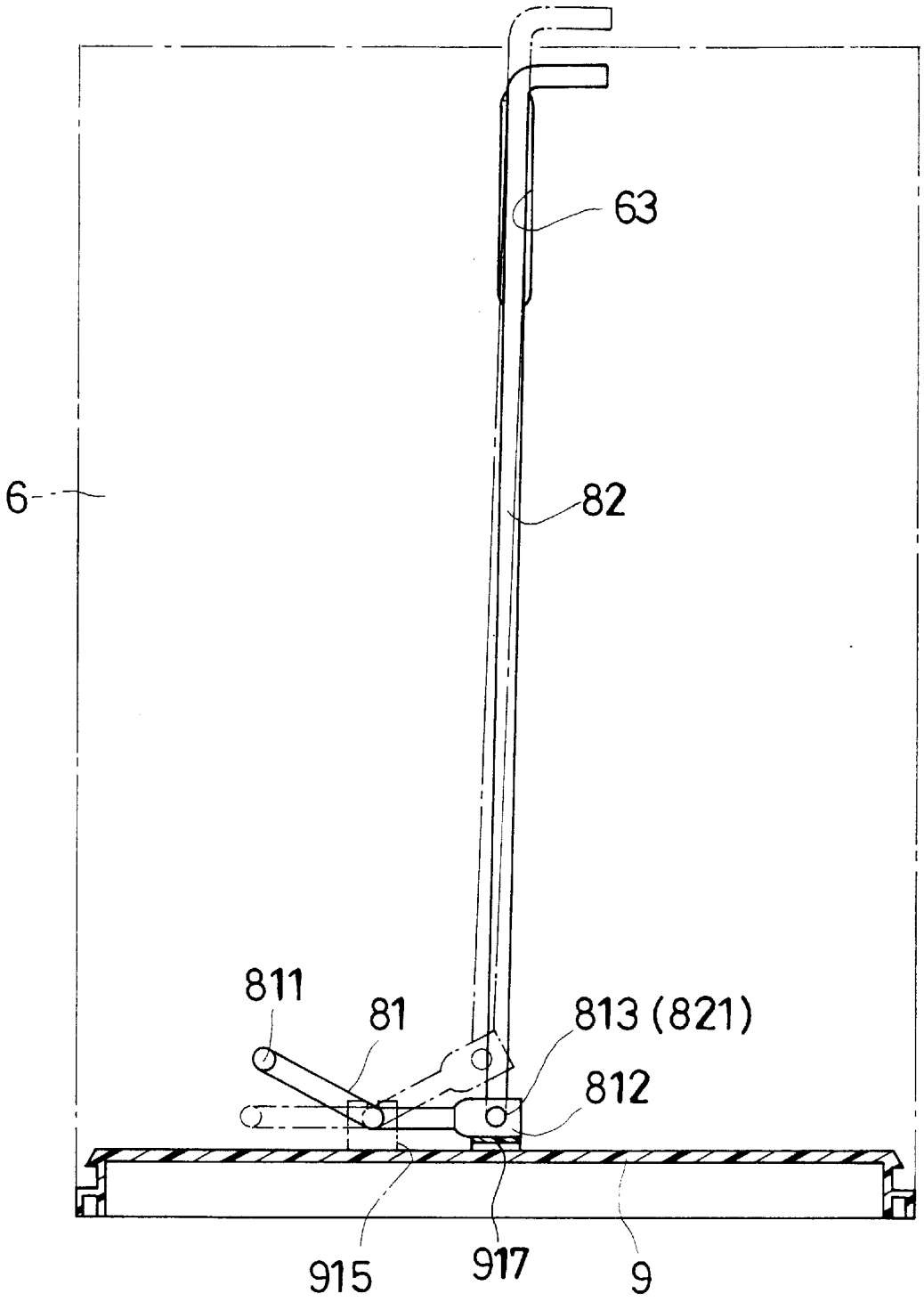
FIG. 3 is a cross-sectional view of the trash can with a cap opened with a step of the present invention.
Figure 4:
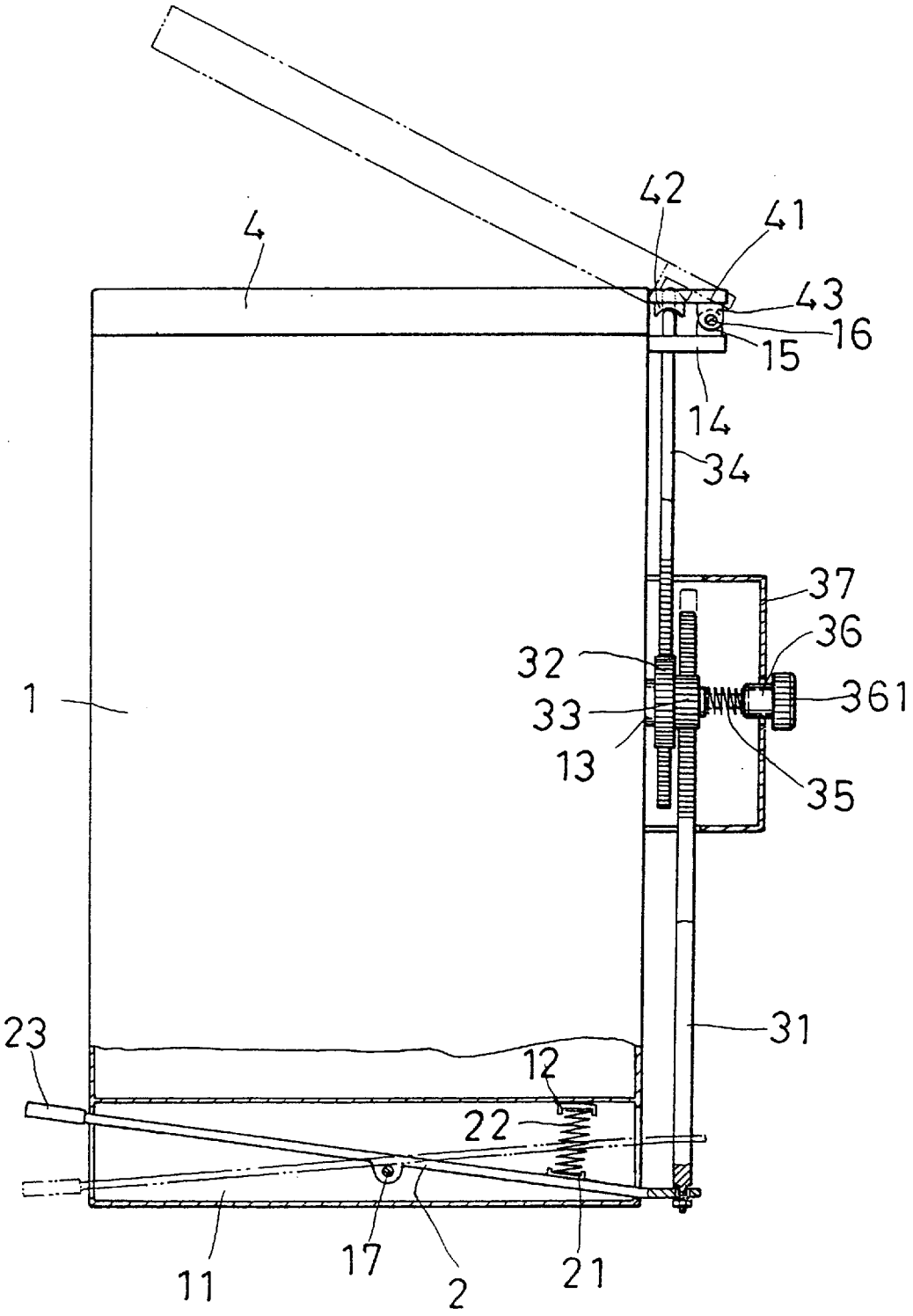
F I G. 4 (PRIOR ART)
FIG. 4 is a cross-sectional view of a known conventional trash can with a cap opened with a step.

In using, as shown in FIGS. 2 and 3, a user can press down the step 61 with a foot to swing open the cap 5. As the first end 811 of the movable rod 81 is located under the rubber piece 611 of the step 61, it will move down to one side as shown in FIG. 3 when the step 61 is pressed down, forcing the second end 812 move up accordingly. Then, the connecting rod 82 is moved up, by means of the bent lower end 821 engaging the round hole 813 of the movable rod 81, with the slot 63 of the outer trash can 6 having enough aperture for the connecting rod 82 to move up and down. Then, the cap 5 is pushed to swing open by the moving-up connecting rod 82 with the pivot connecting the cap 5 with the decorative cap 53. Then, the user can throw trash in the inner trash can 7. If the step 61 is released from pressing down, the cap 5 swings down to its original position of closing on the outer trash can 6, owing to its weight being a little larger than elasticity of the elastic member 917. Additionally, when the outer trash can 6 is being closed, the speed of closing of the cap 5 on the outer trash can 6 can be slowed down owing to the elastic member 812 supports the second end 812 of the movable rod 81 and prevents the cap 5 from making a large sound.

The trash can with a cap opened with a step of the invention has the following advantages, as can be understood from the above description.

1. The moving mechanism for swinging up the cap has only the movable rod and the connecting rod. It is very simple to assemble.
2. The whole shape of the trash can has more beauty and worthiness than the known conventional one, as the moving mechanism is hidden in the outer trash can and the upper end section exposing out of the outer trash can is hidden by the decorative cap.
3. The step can function smoothly and accurately to move the movable rod because of proper friction between the rubber piece of the step and the first end of the movable rod.
4. The cap may be moved down to clsoe on the outer trash can not so quickly to cause large sound because of the elastic member elastically supporting the second end of the movable rod.

What is claimed is:

1. A trash can with a cap opened with a step comprising an outer trash can, a cap provided to close on said outer trash can, an inner trash can placed in said outer trash can, and a moving mechanism provided between said outer trash can and said inner trash can, a bottom case combined with and closing an open lower end of said outer trash can, said moving mechanism being connected to and move together with said cap and a step provided outside of said outer trash can; and characterized by, said cap having a projection on its rear side, said projection having an ear with a hole, and a decorative cap being connected pivotally with said projection;

said outer trash can having a hole in a lower end of a vertical wall at a corresponding location of said step and a vertical slot in an upper end in the vertical wall;

said moving mechanism consisting of a movable rod and a connecting rod combined with each other, said movable rod having a first end bending sloping up to one side and a second end bending for a right angle horizontally, said second end having a round hole for a lower bent end of said connecting rod to engage with, said connecting rod having an upper slowly-curved section and a bent upper end;

said bottom base having a cross member provided with two projections on a front end of a first straight portion, said two prujections separated with a proper aperture, a 7-shaped limit projection near a center of said first straight portion, a buffer projection with a groove behind said limit projection, a stop projection behind said buffer projection on a rear end of said first straight portion of said cross member;

said moving mechanism disposed inside of said outer trash can, said first end of said movable rod protruding out of said outer trash can and located under a lower surface of said step, said movable rod secured with said bottom base by positioned in said aperture of said two projections, in said 7-shaped limit projection, in said groove of said buffer projection and on said stop projection, said connecting rod protruding slopingly out of said slot of said outer trash can and engaging said hole of said ear of said cap, said decorative cap pivotally connected with said projection of said cap to be secured on said outer trash can, said decorative cap hiding said upper end portion of said connecting rod, and thus said cap being combined swingably on said outer trash can.

2. The trash can with a cap opened with a step as claimed in claim 1, wherein said step has a rubber piece fixed under a lower surface of said step, for reinforcing friction between said first end of said movable rod and said step, and thus ensuring pressing action of said step to move said movable rod smoothly and accurately.

3. The trash can with a cap opened with a step as claimed in claim 1, wherein an elastic member is further provided at one side of said buffer projection of said bottom base, and said elastic member has its rear end elastically supporting said second end of said movable rod so that said cap may be prevented from making a large sound in closing on said outer trash can when said step is released from pressing down.

* * * * *

US006010024C1

(12) EX PARTE REEXAMINATION CERTIFICATE (4954th)

United States Patent
Wang

(10) Number: US 6,010,024 C1
(45) Certificate Issued: Jun. 29, 2004

(54) TRASH CAN WITH A CAP OPENED WITH A STEP

(75) Inventor: Tin-Chou Wang, No. 9, Wen Hua 5th Street, Kuei Jen Hsiang, Tainan Hsien (TW)

(73) Assignee: Tin-Chou Wang, Tainan Hsien (TW)

Reexamination Request:
No. 90/006,730, Jul. 30, 2003

Reexamination Certificate for:

| | |
|---|---|
| Patent No.: | **6,010,024** |
| Issued: | **Jan. 4, 2000** |
| Appl. No.: | **09/266,726** |
| Filed: | **Mar. 12, 1999** |

(51) Int. Cl.[7] ..... A47G 19/00
(52) U.S. Cl. ..... 220/23.87; 220/263; 220/264; 220/908
(58) Field of Search ..... 220/23.87, 263, 220/264, 908, 908.1

(56) References Cited

U.S. PATENT DOCUMENTS

| | | | |
|---|---|---|---|
| 966,145 | A | 8/1910 | Wilder |
| 1,237,016 | A | 8/1917 | Brown |
| 1,265,148 | A | 5/1918 | Warren |
| 1,379,677 | A | 5/1921 | Brunhoff |
| 1,461,253 | A | 7/1923 | Owen |
| 1,703,509 | A | 2/1929 | Chandlee |
| 1,799,621 | A | 4/1931 | Shaw |
| 1,820,555 | A | 8/1931 | Buschman |
| 1,881,120 | A | 10/1932 | Fessler et al. |
| 1,891,651 | A | 12/1932 | Padelford et al. |
| 1,966,323 | A | 7/1934 | Von Elm |
| 2,016,558 | A | 10/1935 | Redrup |
| D102,512 | S | 12/1936 | Stallings et al. |
| 2,096,578 | A | 10/1937 | Flanagan |
| D108,642 | S | 3/1938 | Geisel |
| 2,170,604 | A | 8/1939 | Creesy et al. |
| D118,374 | S | 1/1940 | Kamenstein |
| 2,195,033 | A | 3/1940 | Lehman |
| D120,270 | S | 4/1940 | Martinez |
| 4,473,170 | A | 9/1984 | Ciancimino |
| 2,216,279 | A | 10/1940 | Packer |
| 2,242,698 | A | 5/1941 | Evitt |
| 2,255,972 | A | 9/1941 | Harvard |
| 2,308,398 | A | 1/1943 | Stevens |
| 2,311,835 | A | 2/1943 | Johnson |
| D145,970 | S | 11/1946 | Bloomfield |
| D147,646 | S | 10/1947 | Footlik |
| D151,986 | S | 12/1948 | Hamilton |
| 2,475,125 | A | 7/1949 | Brownell |
| 2,563,456 | A | 8/1951 | Brownell |
| 2,904,210 | A | 9/1959 | Grossman |
| 2,907,491 | A | 10/1959 | Gunn |
| 2,910,206 | A | 10/1959 | Hodgson |
| D187,300 | S | 2/1960 | Tupper |
| D187,305 | S | 2/1960 | Leominster |
| D191,546 | S | 10/1961 | Garner |
| D197,007 | S | 12/1963 | Bringhton |
| 3,450,297 | A | 6/1969 | Clerk |
| 3,866,791 | A | 2/1975 | Roper et al. |
| D241,499 | S | 9/1976 | Raftery |
| D256,423 | S | 8/1980 | Bacskay et al. |
| D261,720 | S | 11/1981 | Brazis |
| 4,363,417 | A | 12/1982 | Rhoades et al. |
| 4,445,619 | A | 5/1984 | Kubic et al. |

(List continued on next page.)

FOREIGN PATENT DOCUMENTS

| | | |
|---|---|---|
| TW | 322904 | 12/1997 |

*Primary Examiner*—Nathan J. Newhouse

(57) ABSTRACT

A trash can with a cap opened with a step includes an outer trash can, an inner trash can, a cap closing on the outer trash can, a moving mechanism and a step. The step is positioned outside of the outer trash can with a first end of a movable rod of the moving mechanism located just under the step. So, when the step is pressed down with a foot of a user, the movable rod moves up a connecting rod vertically to push the cap to swing up open, as the cap is pivotally connected with a projection fixed on a rear end of the cap. Further, a decorative cap is pivotally connected with the projection, hiding an upper end of the connecting rod protruding out of the outer trash can so as to beautify the whole shape of the trash can.

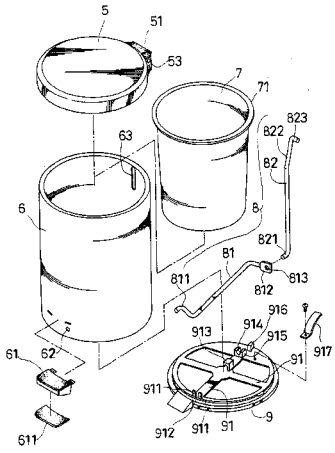

U.S. PATENT DOCUMENTS

| | | | |
|---|---|---|---|
| 4,489,810 | A | 12/1984 | Curtis |
| 4,785,964 | A | 11/1988 | Miller et al. |
| 4,913,308 | A | 4/1990 | Culbertson |
| 4,953,744 | A | 9/1990 | Koyama |
| D312,160 | S | 11/1990 | Calvi |
| D319,905 | S | 9/1991 | Hotchkiss |
| D321,575 | S | 11/1991 | Corps |
| D322,350 | S | 12/1991 | Craft, Jr. et al. |
| 5,082,139 | A | 1/1992 | Quam |
| D327,965 | S | 7/1992 | Chelee |
| D328,510 | S | 8/1992 | Brussing |
| D329,929 | S | 9/1992 | Knoedler et al. |
| 5,163,574 | A | 11/1992 | Sosan |
| 5,170,904 | A | 12/1992 | Neuhaus |
| D332,334 | S | 1/1993 | Jones |
| D332,852 | S | 1/1993 | Delmerico |
| D333,024 | S | 2/1993 | van Buiten |
| D333,025 | S | 2/1993 | Doherty |
| D333,897 | S | 3/1993 | Ward |
| D335,561 | S | 5/1993 | Mihyar |
| D335,562 | S | 5/1993 | Evans |
| 5,230,525 | A | 7/1993 | Delmerico et al. |
| D343,486 | S | 1/1994 | Kimport |
| 5,295,607 | A | 3/1994 | Chang |
| 5,350,079 | A | 9/1994 | Larson et al. |
| 5,356,025 | A | 10/1994 | Renault |
| D352,144 | S | 11/1994 | Brookshire et al. |
| D355,060 | S | 1/1995 | Bernstein et al. |
| D368,563 | S | 4/1996 | Brightbill et al. |
| D377,554 | S | 1/1997 | Adriaansen |
| D381,784 | S | 7/1997 | Keller et al. |
| D393,334 | S | 4/1998 | Presnell et al. |
| D401,028 | S | 11/1998 | Ahern, Jr. et al. |
| 5,842,595 | A | 12/1998 | Williams |
| 5,960,983 | A | 10/1999 | Chan |
| D418,957 | S | 1/2000 | Rashid |
| 6,024,238 | A | 2/2000 | Jaros |
| D431,700 | S | 10/2000 | Roudebush |
| D431,702 | S | 10/2000 | McKeown et al. |
| D435,951 | S | 1/2001 | Yang et al. |
| D439,717 | S | 3/2001 | Konieczny |
| D441,160 | S | 4/2001 | Lin |
| D442,330 | S | 5/2001 | Cousins |
| D446,375 | S | 8/2001 | Daams |
| D447,304 | S | 8/2001 | Niemeyer |
| D447,308 | S | 8/2001 | Lin |
| D447,611 | S | 9/2001 | Lin |
| D450,901 | S | 11/2001 | Lin |
| D453,252 | S | 1/2002 | Lin |
| D453,253 | S | 1/2002 | Lin |
| D453,600 | S | 2/2002 | Lin |
| D453,870 | S | 2/2002 | Lin |
| 6,345,725 | B1 | 2/2002 | Lin |
| D454,239 | S | 3/2002 | Lin |
| D460,595 | S | 7/2002 | Lin |
| D465,629 | S | 11/2002 | Lin |
| D465,630 | S | 11/2002 | Lin |
| D465,893 | S | 11/2002 | Lin |
| D465,894 | S | 11/2002 | Lin |
| D466,265 | S | 11/2002 | Lin |
| D466,667 | S | 12/2002 | Lin |
| D467,696 | S | 12/2002 | Rashid |
| D468,500 | S | 1/2003 | Lin |
| D470,639 | S | 2/2003 | Quan |
| D472,686 | S | 4/2003 | Lin |
| D472,687 | S | 4/2003 | Lin |
| D472,688 | S | 4/2003 | Lin |
| D476,126 | S | 6/2003 | Lin |
| D476,128 | S | 6/2003 | Lin |
| D476,458 | S | 6/2003 | Lin |
| D476,460 | S | 6/2003 | Lin |
| D476,788 | S | 7/2003 | Lin |

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–3 is confirmed.

* * * * *